US009250033B1

(12) United States Patent
Wei

(10) Patent No.: US 9,250,033 B1
(45) Date of Patent: Feb. 2, 2016

(54) TRIGGER LINKAGE MECHANISM FOR USE IN TOY GUN

(71) Applicant: Ho-Sheng Wei, New Taipei (TW)

(72) Inventor: Ho-Sheng Wei, New Taipei (TW)

( * ) Notice: Subject to any disclaimer, the term of this patent is extended or adjusted under 35 U.S.C. 154(b) by 0 days.

(21) Appl. No.: 14/672,726

(22) Filed: Mar. 30, 2015

(51) Int. Cl.

| | |
|---|---|
| ***F41B 11/00*** | (2013.01) |
| ***F41A 19/00*** | (2006.01) |
| ***F41B 11/54*** | (2013.01) |
| ***F41B 11/70*** | (2013.01) |
| ***F41B 11/62*** | (2013.01) |
| ***F41A 9/73*** | (2006.01) |
| ***F41A 19/06*** | (2006.01) |

(52) U.S. Cl.
CPC . *F41B 11/54* (2013.01); *F41A 9/73* (2013.01); *F41A 19/06* (2013.01); *F41B 11/62* (2013.01); *F41B 11/70* (2013.01)

(58) Field of Classification Search
CPC ..... F41B 11/54; F41B 11/62; F41A 19/06; F41A 9/73
USPC ..... 124/31, 48, 74; 42/49.01, 69.01, 65; 89/27.11, 136, 137
See application file for complete search history.

(56) References Cited

U.S. PATENT DOCUMENTS

| | | | | | |
|---|---|---|---|---|---|
| 3,212,489 | A * | 10/1965 | Merz | F41B 11/54 | 124/36 |
| 3,227,148 | A * | 1/1966 | Spack | F41B 11/62 | 124/41.1 |
| 4,422,433 | A * | 12/1983 | Milliman | F41B 11/54 | 124/44.7 |
| 4,589,327 | A * | 5/1986 | Smith | F41A 17/74 | 42/70.08 |
| 4,908,970 | A * | 3/1990 | Bell | F41A 19/12 | 42/69.01 |
| 5,018,292 | A * | 5/1991 | West | F41A 19/16 | 42/69.02 |
| 5,160,795 | A * | 11/1992 | Milliman | F41A 19/53 | 124/48 |
| 5,216,191 | A * | 6/1993 | Fox | F41A 3/12 | 42/70.05 |
| 5,285,766 | A * | 2/1994 | Milliman | F41B 11/54 | 124/48 |
| 5,400,536 | A * | 3/1995 | Milliman | F41A 19/53 | 124/74 |
| 5,622,160 | A * | 4/1997 | Casas Salva | F41B 11/54 | 124/59 |
| 5,906,191 | A * | 5/1999 | Wonisch et al. | F41A 17/22 | 124/31 |
| 6,578,565 | B2 * | 6/2003 | Casas Salva | F41B 11/62 | 124/40 |
| 6,729,322 | B2 * | 5/2004 | Schavone | F41B 11/51 | 124/48 |
| 6,745,755 | B2 * | 6/2004 | Piccini | F41A 9/28 | 124/49 |
| 7,159,584 | B2 * | 1/2007 | Maeda et al. | F41B 11/62 | 124/41.1 |
| 7,669,588 | B2 * | 3/2010 | Maeda | F41B 11/54 | 124/74 |
| 7,950,381 | B2 * | 5/2011 | Maeda | F41B 11/54 | 124/45 |
| 7,963,280 | B2 * | 6/2011 | Maeda | F41B 11/54 | 124/45 |
| 9,068,792 | B2 * | 6/2015 | Macy | F41B 11/723 | |

* cited by examiner

*Primary Examiner* — Alexander Niconovich
(74) *Attorney, Agent, or Firm* — Chun-Ming Shih; HDLS IPR Services

(57) ABSTRACT

A trigger linkage mechanism for use in toy gun includes: a trigger pivoted to a gun frame and formed with a push block; a linkage member having one end formed with a first pivotal part and the other end formed with a second pivotal part. The linkage member is formed with an abutting part disposed between the two pivotal parts and abutted against the push block; a pull member pivoted to the second pivotal part and formed with a pawl part capable of being correspondingly buckled with the buckle part; a first recovery spring clamped between the gun frame and the linkage member; and a second recovery spring clamped between the linkage member and the pull member. Accordingly, the rotation radian and speed of the pawl part is able to be controlled and adjusted.

8 Claims, 8 Drawing Sheets

TRIGGER LINKAGE MECHANISM FOR USE IN TOY GUN

BACKGROUND OF THE INVENTION

1. Field of the Invention

The present invention relates to a trigger linkage mechanism, especially to a trigger linkage mechanism for use in toy gun.

2. Description of Related Art

The gun frame of a toy gun is installed with a trigger linkage mechanism and a magazine which are correspondingly disposed. The trigger linkage mechanism is able to drive the magazine to rotate to a predetermined location, thereby enabling a bore part of the magazine to be correspondingly arranged with a gun barrel during each firing of the toy gun, so a pellet can be smoothly fired and prevented from being stopped between the bore part of the magazine and the gun barrel.

Disadvantages of a conventional trigger linkage mechanism are as follows. Take the U.S. Pat. No. 5,400,536 for example. The U.S. Pat. No. 5,400,536 discloses a trigger linkage mechanism having the front end formed as a pawl member, when the trigger is pulled, the pawl member is enabled to perform an arc-shaped movement with the rotation shaft served as a center, so the pawl member is able to be buckled with a buckle part of a magazine, and the magazine is able to be driven to rotate to a predetermined location. In addition, the trigger linkage mechanism is installed with an arc-shaped spring between the pawl member and a pawl member supporter, so the arc-shaped spring is able to drive the pawl member to be recovered when the trigger is released, thereby allowing the pawl member to be released from the buckle part.

The above-mentioned trigger linkage mechanism utilizes the arc-shaped spring for controlling the rotation radian and speed of the pawl member, however, the design for the arc-shaped spring itself is provided with a vertical elastic force and a horizontal elastic force, so the rotation radian and speed of the pawl member is unable to be precisely controlled, and the firing speed and the user experience of the toy gun may not be as good as anticipated.

In view of the above-mentioned disadvantages, the applicant of the present invention has devoted himself for researching and inventing a novel design for improving the above-mentioned disadvantages.

SUMMARY OF THE INVENTION

The present invention is to provide a trigger linkage mechanism for use in toy gun, in which the rotation radian and speed of a pawl part is able to be controlled and adjusted, thereby providing an excellent firing speed and a better user experience.

Accordingly, the present invention provides a trigger linkage mechanism for use in toy gun, the toy gun includes a gun frame and a magazine mechanism, the magazine mechanism includes a buckle part, the trigger linkage mechanism includes: a trigger pivoted to the gun frame and formed with a push block; a linkage member having one end formed with a first pivotal part pivoted to the gun frame and the other end formed with a second pivotal part, wherein the linkage member is formed with an abutting part disposed between the first pivotal part and the second pivotal part, and the push block and the abutting part are abutted against each other; a pull member pivoted to the second pivotal part, wherein the pull member is formed with a pawl part capable of being correspondingly buckled with the buckle part thereby enabling the magazine mechanism to be driven to rotate relative to the gun frame; a first recovery spring clamped between the gun frame and the linkage member; and a second recovery spring clamped between the linkage member and the pull member.

DETAILED DESCRIPTION OF THE INVENTION

Figure 1:
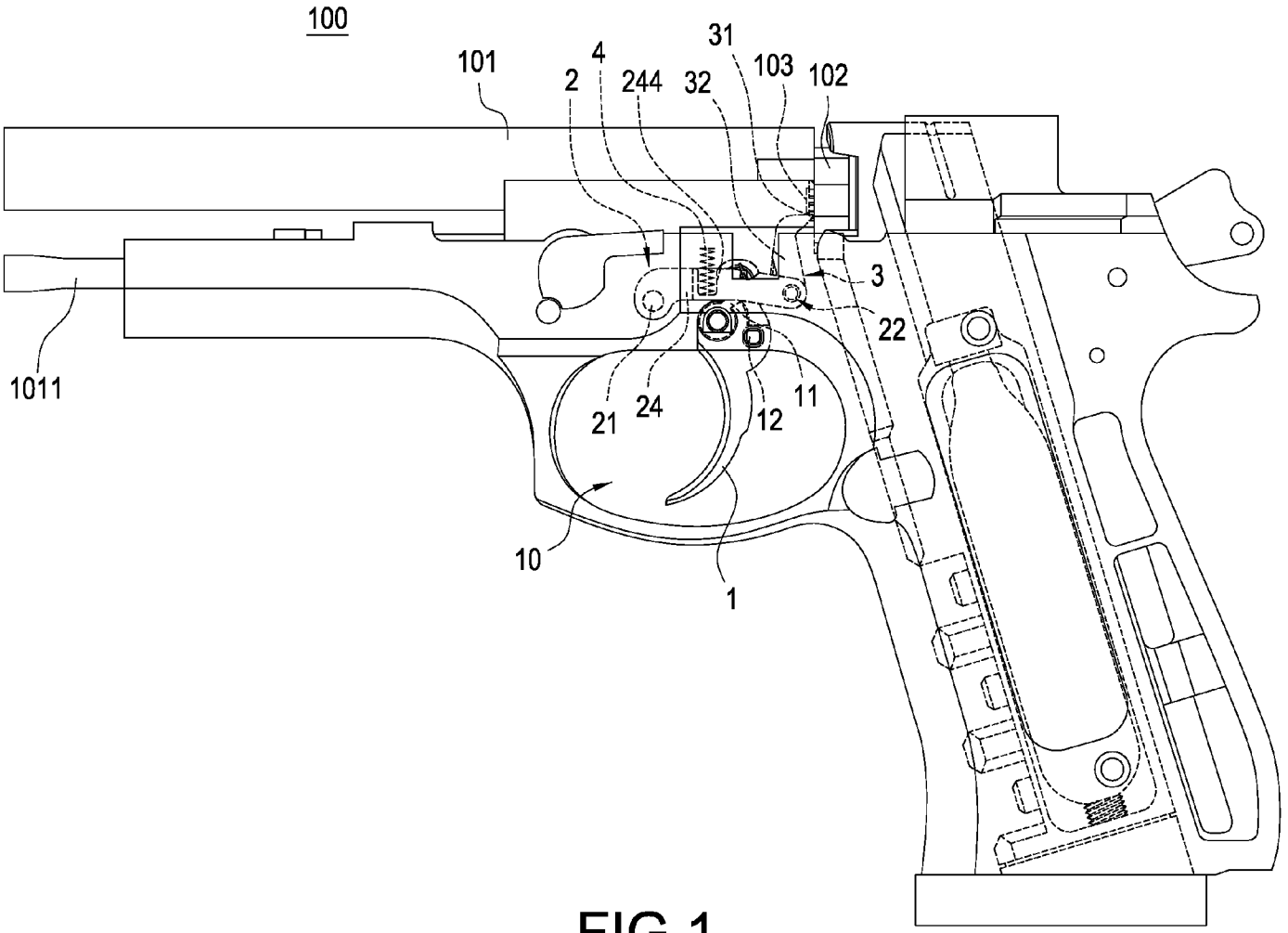
FIG. 1 is a schematic view showing the assembly of a toy gun according to one preferred embodiment of the present invention.
Figure 2:
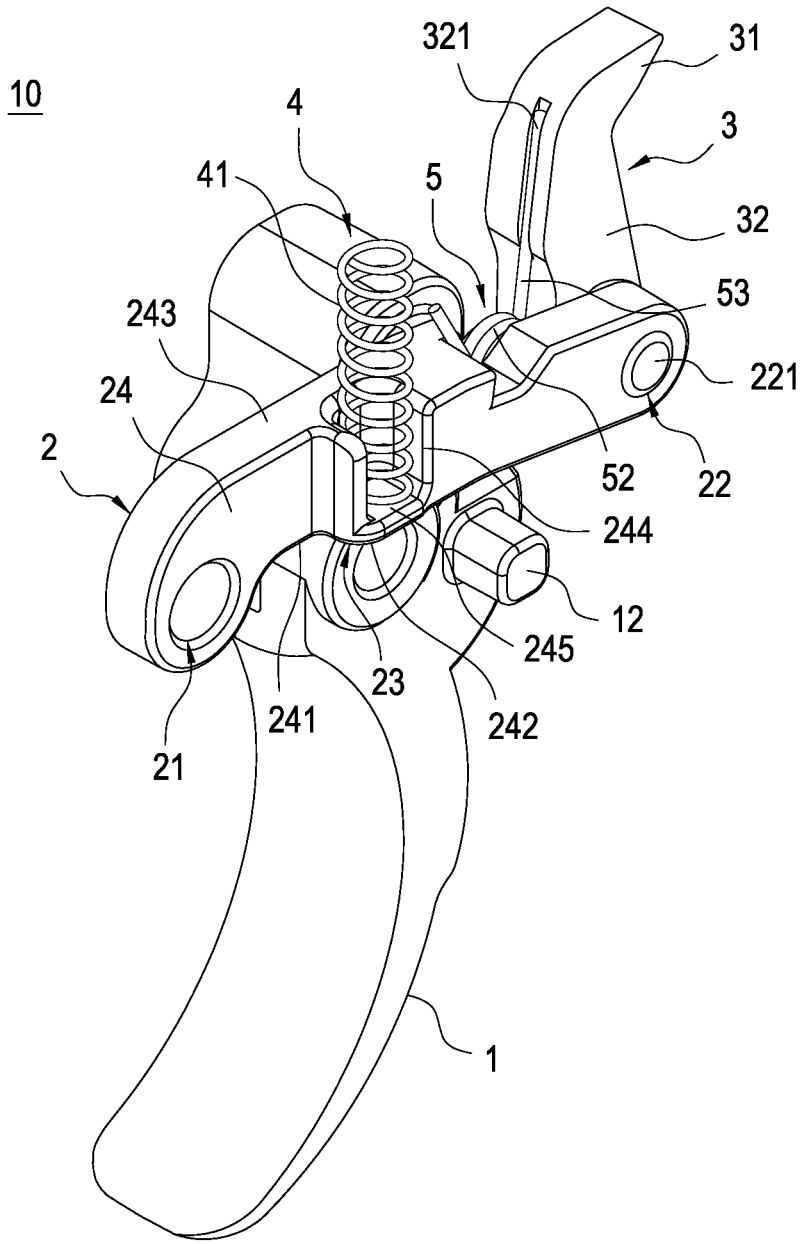
FIG. 2 is a perspective view showing the assembly of a trigger linkage mechanism according to one preferred embodiment of the present invention.
Figure 3:
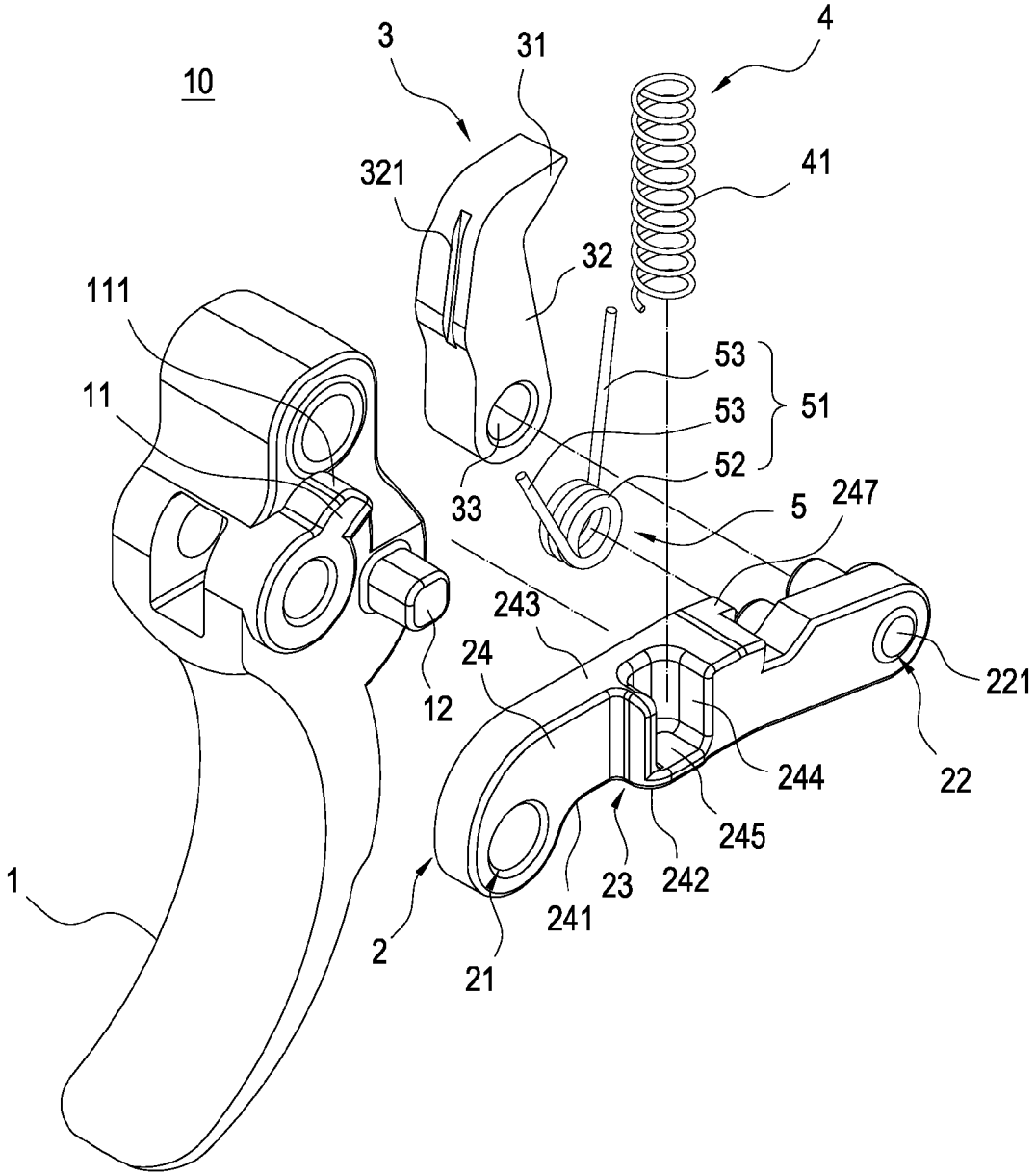
FIG. 3 is a perspective exploded view showing the trigger linkage mechanism according to one preferred embodiment of the present invention.
Figure 4:
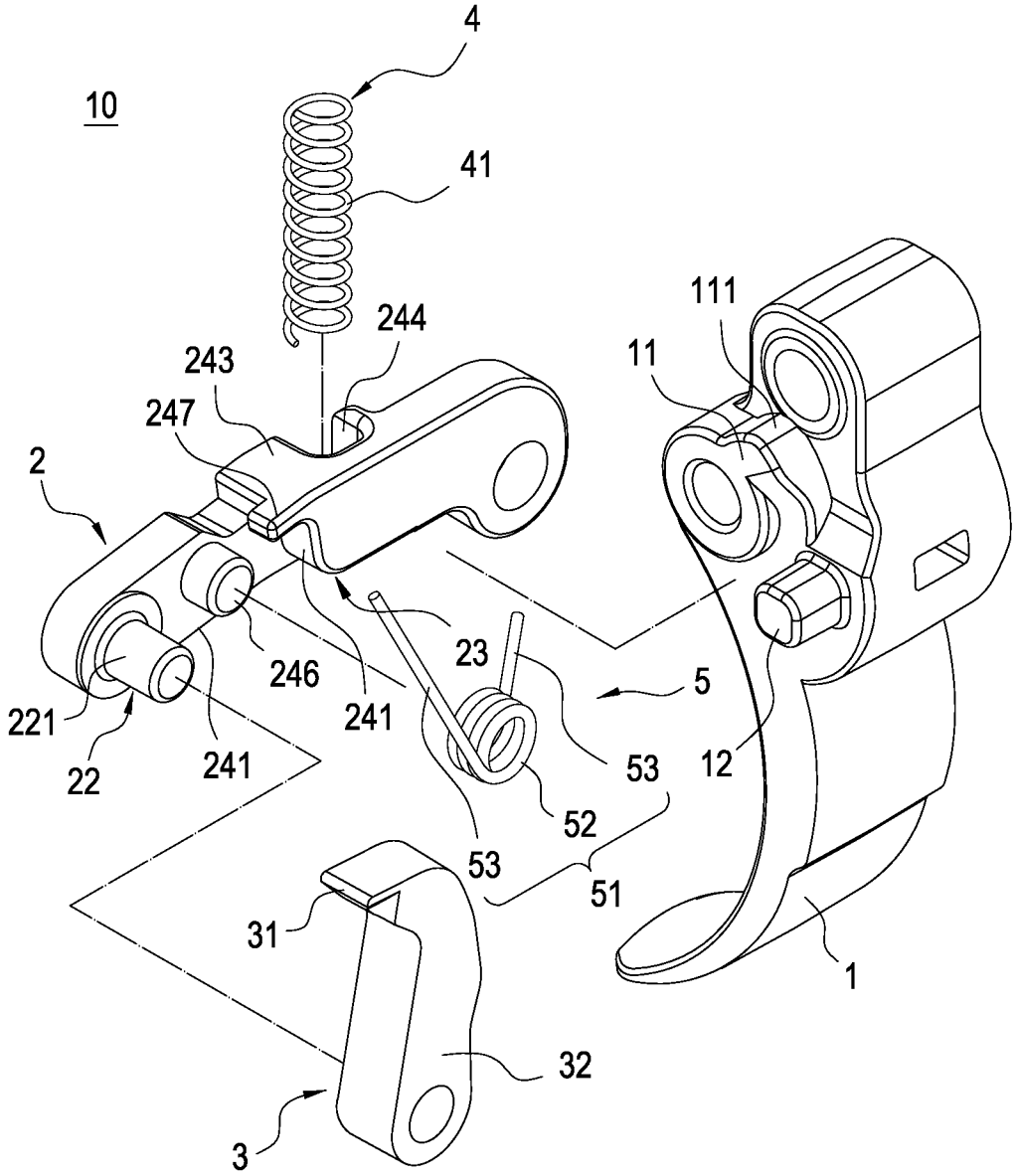
FIG. 4 is another perspective exploded view showing the trigger linkage mechanism according to one preferred embodiment of the present invention.
Figure 5:
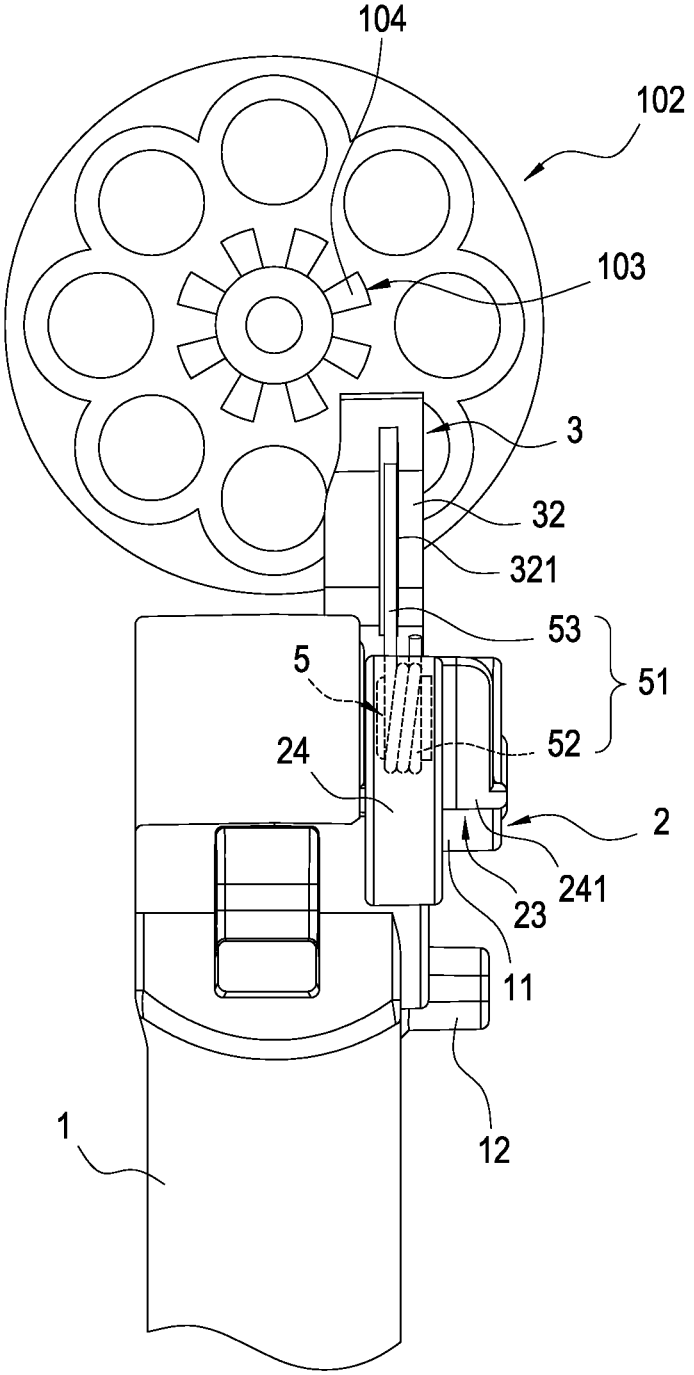
FIG. 5 is a schematic view showing the operating status of the trigger linkage mechanism according to one preferred embodiment of the present invention.

One preferred embodiment of the present invention will be described with reference to the drawings.

Please refer from FIG. 1 to FIG. 8, the present invention provides a trigger linkage mechanism for use in toy gun, the trigger linkage mechanism 10 mainly includes a trigger 1, a linkage member 2, a pull member 3, a first recovery spring 4 and a second recovery spring 5.

The toy gun 100 includes a gun frame 101 and a magazine mechanism 102. The magazine mechanism 102 includes a buckle part 103, and the buckle part 103 includes a plurality of buckle blocks 104 annularly arranged at the outer periphery of the rotation center of the magazine mechanism 102. The magazine mechanism 102 includes a plurality of bore parts 105 arranged at the outer side of each of the buckle blocks 104. Wherein, the gun frame 101 includes a gun barrel 1011.

The trigger 1 is pivoted to the gun frame 101. The trigger 1 is formed with a push block 11, and the push block 11 is formed with an arc-shaped abutting edge 111. The trigger 1 is formed with a stop block 12 disposed below the push block 11, and the stop block 12 is able to stop the linkage member 2.

The linkage member 2 is disposed above the trigger 1. One end of the linkage member 2 is formed with a first pivotal part 21 pivoted to the gun frame 101, and the other end thereof is formed with a second pivotal part 22. The linkage member 2 includes an abutting part 23 disposed between the first pivotal part 21 and the second pivotal part 22, and the push block 11 and the abutting part 23 are abutted against each other.

Details are provided as follows. The linkage member 2 is formed as a horizontal rod 24. The horizontal rod 24 is formed with a bottom edge 241. The abutting part 23 includes an arc-shaped block 242 extended from the horizontal rod 24 and disposed on the bottom edge 241, and the arc-shaped abutting edge 111 and the arc-shaped block 242 are abutted against each other.

In addition, the horizontal rod 24 is formed with a top edge 243. The horizontal rod 24 is formed with a groove 244 from the top edge 243 and the top end of the arc-shaped block 242. The groove 244 is formed with a bottom wall 245. Moreover, the horizontal rod 24 is extended with a fasten stem 246 and an L-shaped buckle block 247. Furthermore, the second pivotal part 22 includes a pivotal stem 221 connected to the linkage member 2.

The pull member 3 is pivoted to the second pivotal part 22. The pull member 3 is formed with a pawl part 31 extended towards a direction away from the linkage member 2, and the pawl part 31 is able to be correspondingly buckled with the buckle part 103, thereby enabling the magazine mechanism 102 to be driven to rotate relative to the gun frame 101.

In addition, the pull member 3 is formed as a vertical rod 32. The vertical rod 32 is formed with an elongated groove 321. The pull member 3 is formed with a pivotal hole 33, and the pivotal stem 221 is pivoted in the pivotal hole 33.

The first recovery spring 4 is clamped between the gun frame 101 and the linkage member 2. Details are provided as follows. The first recovery spring 4 is formed as a helical spring 41, and the helical spring 41 is received in the groove 244 and clamped between the gun frame 101 and the bottom wall 245.

The second recovery spring 5 is clamped between the linkage member 2 and the pull member 3. Details are provided as follows. The second recovery spring 5 is formed as a torsional spring 51. The torsional spring 51 is formed with an annular ring 52 and two elastic pins 53 extended from two ends of the annular ring 52. The annular ring 52 is sleeved on the fasten stem 246. One of the elastic pins 53 is abutted against the L-shaped buckle block 247, and the other elastic pin 53 is received in and abutted against the elongated groove 321.

As shown from FIG. 1 to FIG. 5, the assembly of the trigger linkage mechanism 10 of the present invention is summarized as follows. The trigger 1 is pivoted to the gun frame 101, and the trigger 1 is formed with the push block 11; one end of the linkage member 2 is formed with the first pivotal part 21 pivoted to the gun frame 101, the other end thereof is formed with the second pivotal part 22, the linkage member 2 includes the abutting part 23 disposed between the first pivotal part 21 and the second pivotal part 22, and the push block 11 and the abutting part 23 are abutted against each other; the pull member 3 is pivoted to the second pivotal part 22, the pull member 3 is formed with the pawl part 31, the pawl part 31 is able to be correspondingly buckled with the buckle part 103, thereby enabling the magazine mechanism 102 to be driven to rotate relative to the gun frame 101; the first recovery spring 4 is disposed between the gun frame 101 and the linkage member 2; and the second recovery spring 5 is disposed between the linkage member 2 and the pull member 3. Accordingly, the rotation radian and speed of the pawl part 31 is able to be controlled and adjusted through the location of the abutting part 23, the first recovery spring 4 and the second recovery spring 5, thereby enabling the toy gun 10 to be provided with an excellent firing speed and a better user experience.

As shown from FIG. 5 to FIG. 8, which show the operating statuses of the trigger linkage mechanism 10 according to one preferred embodiment of the present invention. Firstly, as shown from FIG. 5 to FIG. 7, when the trigger 1 is pulled, the arc-shaped abutting edge 111 and the arc-shaped block 242 are abutted against each other, so the motion of pulling the trigger 1 pushes the linkage member 2 to be upwardly moved, then the linkage member 2 is able to drive the pull member 3 to be upwardly moved and rotated relative to the second pivotal part 22. The second recovery spring 5 pushes the pawl part 31 to be mutually buckled with the buckle part 103, in other words the pawl part 31 is pushed for being mutually buckled with one of the buckle blocks 104, thereby enabling the magazine mechanism 102 to be driven to rotate relative to the gun frame 101 so as to rotate to a predetermined location, wherein the predetermined location is defined as allowing the bore part 105 of the magazine mechanism 102 and the gun barrel 1011 to be correspondingly arranged and communicated with each other, so a pellet 200 is able to be smoothly fired, thereby preventing the pellet 200 from being stopped between the bore part 105 and the gun barrel 1011.

Figure 6:
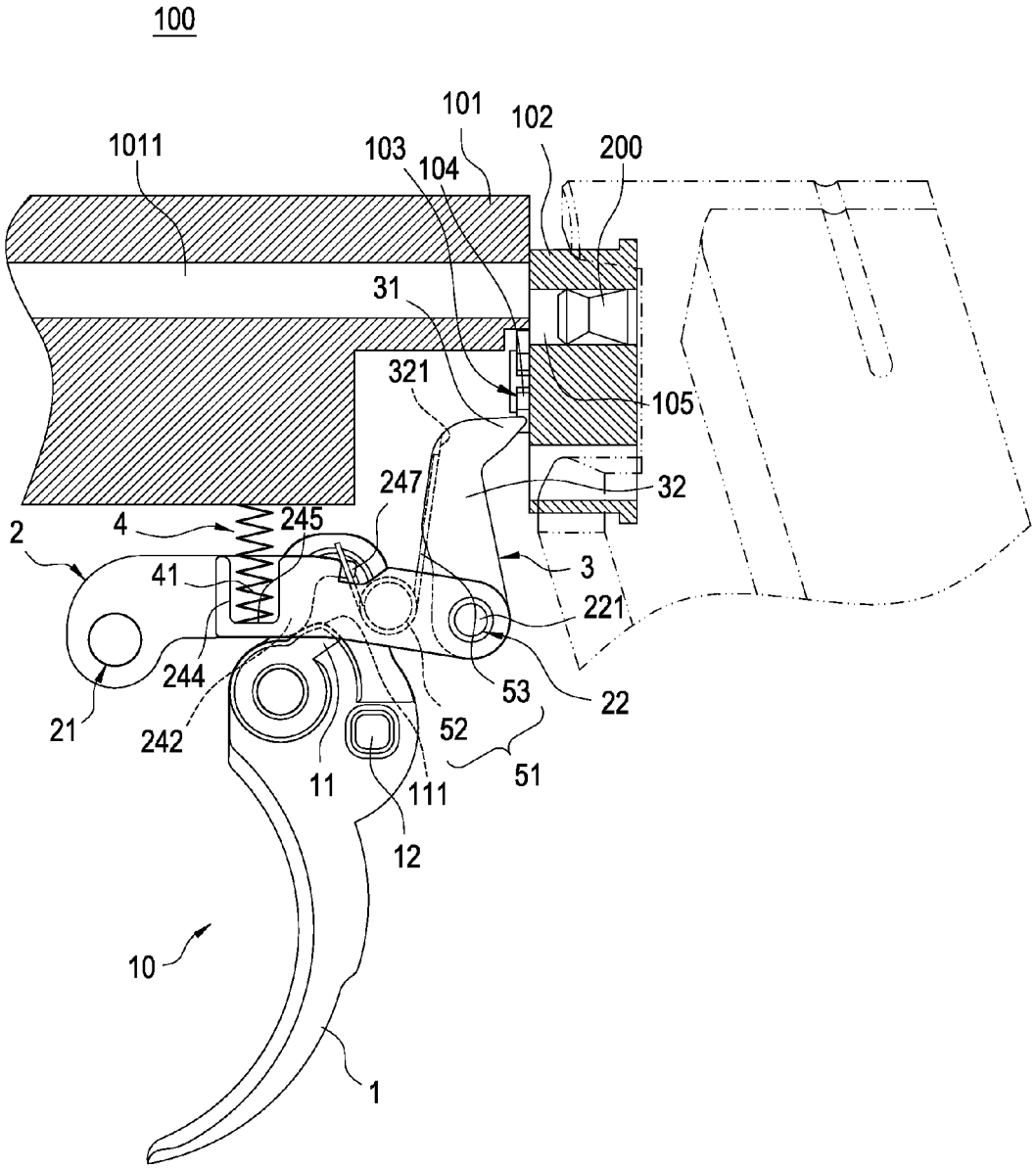
FIG. 6 is another schematic view showing the operating status of the trigger linkage mechanism according to one preferred embodiment of the present invention.
Figure 7:
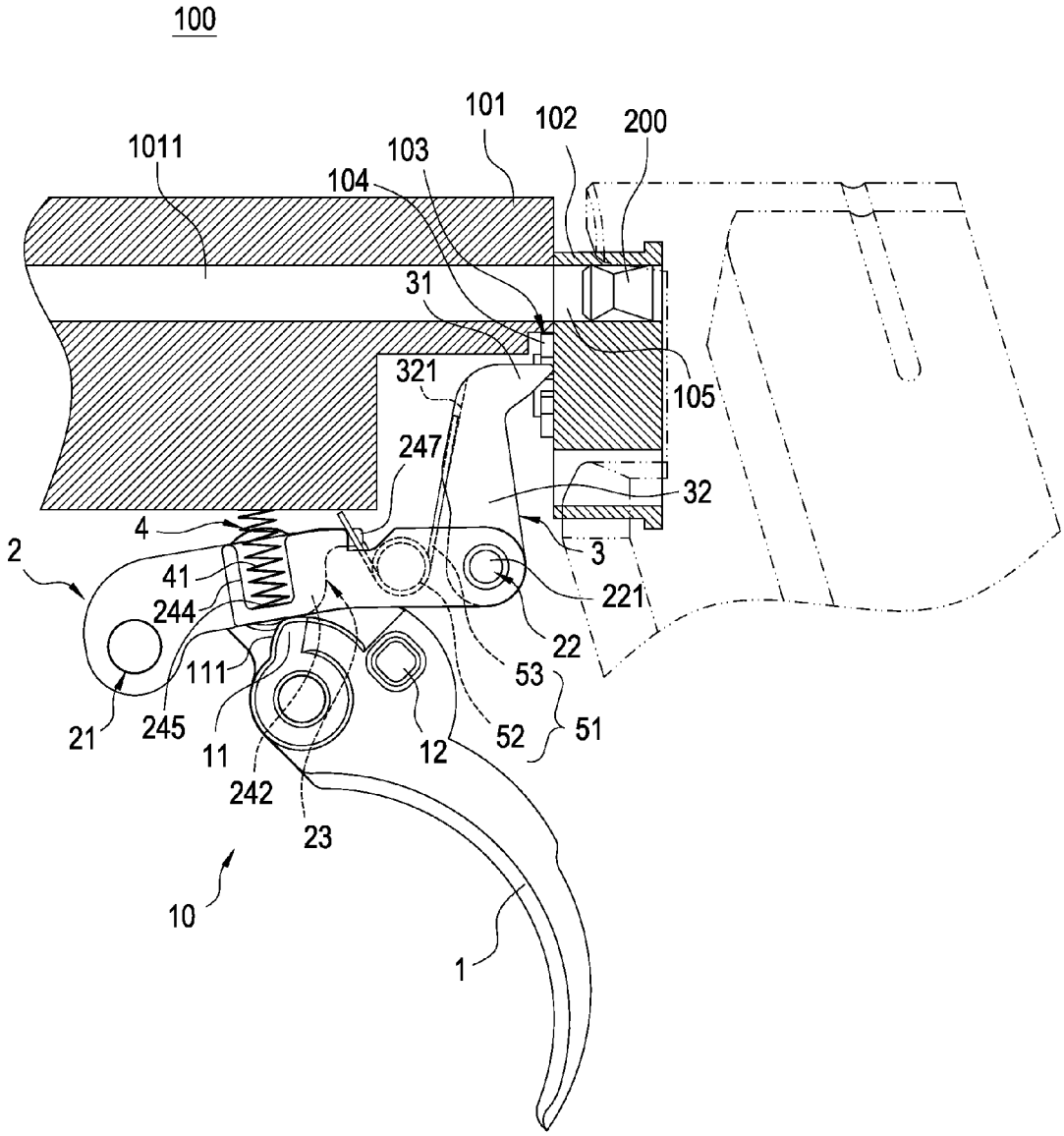
FIG. 7 is one another schematic view showing the operating status of the trigger linkage mechanism according to one preferred embodiment of the present invention.
Figure 8:
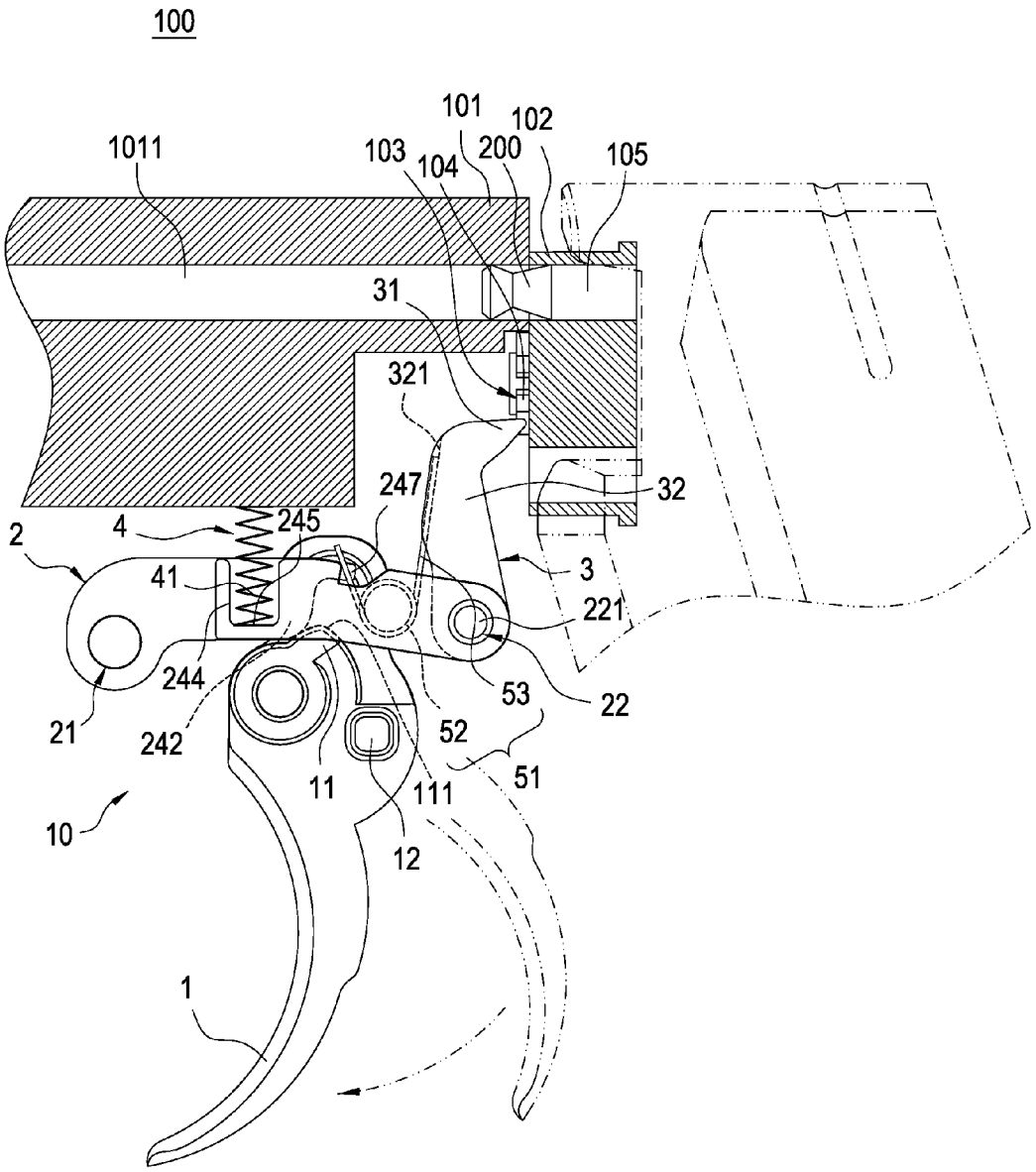
FIG. 8 is still one another schematic view showing the operating status of the trigger linkage mechanism according to one preferred embodiment of the present invention.

As shown in FIG. 8, when the trigger 1 is released, the first recovery spring 4 pushes the linkage member 2 to be downwardly moved for allowing the pawl part 31 to be released from the buckle block 104, so the linkage member 2 and the pull member 3 are able to be recovered to the locations shown in FIG. 6.

Wherein, the second recovery spring 5 drives the pawl part 31 to be mutually buckled with the buckle part 103, the first recovery spring 4 drives the pawl part 31 to be recovered, and the abutting part 23 is disposed between the first pivotal part 21 and the second pivotal part 22; as such, the rotation radian and speed of the pawl part 31 is able to be adjusted through adjusting the elastic coefficient of the second recovery spring 5, the elastic coefficient of the first recovery spring 4 and the spaced distance of the abutting part 23, the first pivotal part 21 and the second pivotal part 22, thereby enabling the toy gun 10 to be provided with an excellent firing speed and a better user experience.

Although the present invention has been described with reference to the foregoing preferred embodiment, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A trigger linkage mechanism for use in a toy gun, the toy gun including a gun frame and a magazine mechanism, the magazine mechanism including a buckle part, and the trigger linkage mechanism including:

a trigger, pivoted to the gun frame at a pivotal portion and formed with a push block at the pivotal portion;

a linkage member, having one end formed with a first pivotal part and an opposite end formed with a second pivotal part, wherein the linkage member is pivoted to the gun frame at the first pivotal part and further formed with an abutting part disposed between the first pivotal part and the second pivotal part, and the push block and the abutting part are abutted against each other;

a pull member, pivoted to the linkage member at the second pivotal part, wherein the pull member is further formed with a pawl part capable of being correspondingly buckled with the buckle part, thereby enabling the magazine mechanism to be driven to rotate relative to the gun frame;

a first recovery spring, clamped between the gun frame and the abutting part of the linkage member; and a second recovery spring clamped between the linkage member and the pull member.

2. The trigger linkage mechanism for use in toy gun according to claim 1, wherein the linkage member is formed as a horizontal rod, the horizontal rod is formed with a bottom edge adjacent to the pivotal portion, the abutting part includes an arc-shaped block extended from the horizontal rod and disposed on the bottom edge, the push block is formed with an arc-shaped abutting edge, and the arc-shaped abutting edge and the arc-shaped block are abutted against each other.

3. The trigger linkage mechanism for use in toy gun according to claim 2, wherein a top end of the arc-shaped block is formed with a groove, the groove is formed with a bottom wall, the first recovery spring is formed as a helical spring, and the helical spring is received in the groove and clamped between the gun frame and the bottom wall.

4. The trigger linkage mechanism for use in toy gun according to claim 2, wherein the horizontal rod is formed with a top edge opposite to the bottom edge, the horizontal rod is formed with a groove concave from the top edge, the groove is formed with a bottom wall, the first recovery spring is formed as a helical spring, and the helical spring is received in the groove and clamped between the gun frame and the bottom wall.

5. The trigger linkage mechanism for use in toy gun according to claim 1, wherein the trigger is formed with a stop block adjacent to the pivotal portion and disposed below the push block, and the stop block is able to stop the linkage member.

6. The trigger linkage mechanism for use in toy gun according to claim 1, wherein the linkage member is formed as a horizontal rod, the horizontal rod is formed with a fasten stem and an L-shaped buckle block, the pull member is formed as a vertical rod, the vertical rod is formed with an elongated groove, the second recovery spring is formed as a torsional spring, the torsional spring is formed with an annular ring and two elastic pins extended from two ends of the annular ring, the annular ring is sleeved on the fasten stem, one of the elastic pins is abutted against the L-shaped buckle block, and the other elastic pin is received in and abutted against the elongated groove.

7. The trigger linkage mechanism for use in toy gun according to claim 6, wherein the second pivotal part is formed with a pivotal stem, the pull member is formed with a pivotal hole, and the pivotal stem is pivoted in the pivotal hole.

8. The trigger linkage mechanism for use in toy gun according to claim 1, wherein the pull member is formed with a pawl part extended towards a direction away from the linkage member.

* * * * *